US005655937A

United States Patent [19]

Brogdon

[11] Patent Number: 5,655,937

[45] Date of Patent: Aug. 12, 1997

[54] WATER-LIFT MUFFLER EVACUATION DEVICE

[76] Inventor: Douglas Brogdon, 6903 N. Lagoon, Apt. 53, Panama City Beach, Fla. 32408

[21] Appl. No.: 538,122

[22] Filed: Oct. 2, 1995

[51] Int. Cl.[6] ..... B63H 21/38

[52] U.S. Cl. ..... 440/88; 114/183 R; 440/113

[58] Field of Search ..... 440/88, 89, 113; 114/183 R; 181/225, 235

[56] References Cited

U.S. PATENT DOCUMENTS

| | | | |
|---|---|---|---|
| 2,573,986 | 11/1951 | Roper | 440/89 |
| 4,019,456 | 4/1977 | Harbert | 440/88 |
| 5,096,446 | 3/1992 | Tazaki et al. | 440/89 |
| 5,393,252 | 2/1995 | Brogdon | 440/88 |

*Primary Examiner*—Sherman Basinger
*Attorney, Agent, or Firm*—Carnes, Cona, and Dixon

[57] ABSTRACT

A device is disclosed which allows water-lift mufflers, silencers or suppressors to be fully flushed, while in or out of the water, without running the engines. The device can be mounted between a remote access panel or control panel and a conventional fresh water flush valve. Fresh water flow provides fluid power to a primary section impeller or turbine, where power is then mechanically transmitted to an evacuation or secondary section impeller or turbine through a shaft on which both impellers mount. The inlet section of the secondary section impeller connects by hose to the drain plug universally present on marine engine mufflers, silencers and suppressors. The outlet section of the secondary section impeller connects by hose to an overboard drain. Fresh water, having sufficient flow and pressure, applied to the device drives the primary section impeller, causing the impeller to rotate. Fresh water exits the outlet of the primary section impeller through hose and continues towards the fresh water flushing valve for flushing purposes. Being mounted on the common shaft, the secondary section impeller rotates with the primary section impeller. Rotation of the secondary section impeller creates negative pressure or vacuum at the inlet section and draws water from the muffler, silencer or suppressor. Water from the muffler travels through the secondary section impeller and then discharges overboard.

18 Claims, 4 Drawing Sheets

WATER-LIFT MUFFLER EVACUATION DEVICE

BACKGROUND OF THE INVENTION

1. Field of the Invention

The present invention relates, generally, to fresh water flushing devices for marine engines and, more particularly, to evacuation devices for marine engines that draw entrained raw water from mufflers, silencers or suppressors.

2. Description of the Prior Art

Practically every boat or water vessel, of approximately 34 feet or longer, employs a muffler system, suppressor, or silencer, as illustrated in FIG. 1. These systems are used to quiet the boat in order to provide for a more pleasurable boating experience. Most of these vessels use a vertical lift exhaust suppressor of some variety or another. Engine exhaust pressure 1 is used to force the accumulation of water 2 from the suppressor up, via an exhaust hose 3, to the exhaust pipe(s) 4. If the engine is not running, and a flushing system is utilized, then the water may overfill the exhaust system and fill the engine. This is an undesirable situation. Additionally, water from the water lift muffler 6, when the engine is not running, can only be removed manually, via a drain cock 5. This is a tedious and time consuming process. Further, the design and configuration of these conventional systems does not completely empty the water within the water lift muffler. Accordingly, what is needed is a device which will adequately remove water completely from the water lift muffler, whether the boat is in or out of the water. This device should be easily retrofitted into an existing system as well as not require an addition power source to be utilized for the activation of the device.

SUMMARY OF THE INVENTION

The appended claims define the present invention. The attached drawings show the preferred embodiment. For the purpose of summarizing the invention, the invention may be considered incorporated into a fresh water flushing system for evacuating raw water in a muffler, silencer or suppressor of a marine engine whether the vessel sits in or out of the water.

The water-lift muffler evacuation device comprises a housing including a primary section having inlet and outlet ports and a secondary section having inlet and outlet ports. Primary and secondary sections contain primary and secondary impellers, respectively, mounted on a common shaft. Primary and secondary impellers communicate by proper fluid connection to the inlet and outlet ports where fluid introduced into the inlet port of the primary section causes shaft rotation and vacuum arises in the inlet port of the secondary section.

The water-lift muffler evacuation device is employed by connecting: (i) the inlet port of the primary section to a source of flushing liquid, (ii) the outlet port of the primary section to the marine or other engine wanting flushing, (iii) the inlet section of the secondary section to the raw water requiring lift for discharge, and (iv) the outlet port of the secondary section to overboard discharge. Then, flow of flushing liquid drives the primary section impeller and, hence, the secondary section impeller producing vacuum in the inlet port of the secondary section. Finally, pressure differential between raw water and secondary section inlet port naturally moves raw water to the water-lift evacuation device, through the device and to the overboard discharge.

The water-lift muffler evacuation device of the present invention comprises a unit which may be mounted permanently on the vessel.

Accordingly, it is an object of the present invention provide a water-lift muffler evacuation device capable of evacuating raw water from mufflers, silencers and suppressors of marine engines whether vessels sit in or out of the water.

It is another object of the present invention to provide a water-lift muffler evacuation device capable of working with various marine engines equipped with gill manifolds, super chargers, custom manifolds, turbo chargers or most other similar equipment.

Still another object of the present invention to provide a water-lift muffler evacuation device capable of easily retrofitting into existing systems in all types and model vessels.

Still a further object of the present invention is to provide a water-lift muffler evacuation device capable of joining with other flushing equipment to ensure complete and correct flushing of harmful minerals, salts and other residues from all equipment holding raw water for cooling, muffling or other purposes.

Yet another object of the present invention to provide a water-lift muffler evacuation device capable of easily incorporating as Original Equipment Manufactured ("OEM") components into newly manufactured vessels.

It is yet another object of the present invention to provide a water-lift muffler evacuation device capable of resisting the corrosive effects of salt air and sea water on the fixed and movable working parts of the invention.

Still a further object of the present invention to provide a water-lift muffler evacuation device capable of remaining conjoined with the marine engine while not impairing operation or performance of the engine.

It is yet another object of the present invention to provide for a means of removing salt water from a water life muffler without an additional power source.

It is a final object of the present invention to provide a water-lift muffler evacuation device in accordance with the preceding objects and which will conform to conventional forms of manufacture, be simple to construct and easy to use, in order to provide a device that will be economically feasible, long lasting, not troublesome to operate, and will provide superior flushing performance.

The foregoing outlines various pertinent objects of the invention. These objects should be construed as merely illustrative of some of the more prominent features and applications of the intended invention. Many other beneficial results can be obtained by applying the disclosed invention within the scope of the disclosure. Accordingly, other objects and a fuller understanding of the invention may be had by referring the detailed description of the preferred embodiments, the accompanying drawings and the claims.

BRIEF DESCRIPTION OF THE DRAWINGS

Similar reference numerals refer to similar parts throughout the several views of the drawings.

DESCRIPTION OF THE PREFERRED EMBODIMENT

Figure 1:
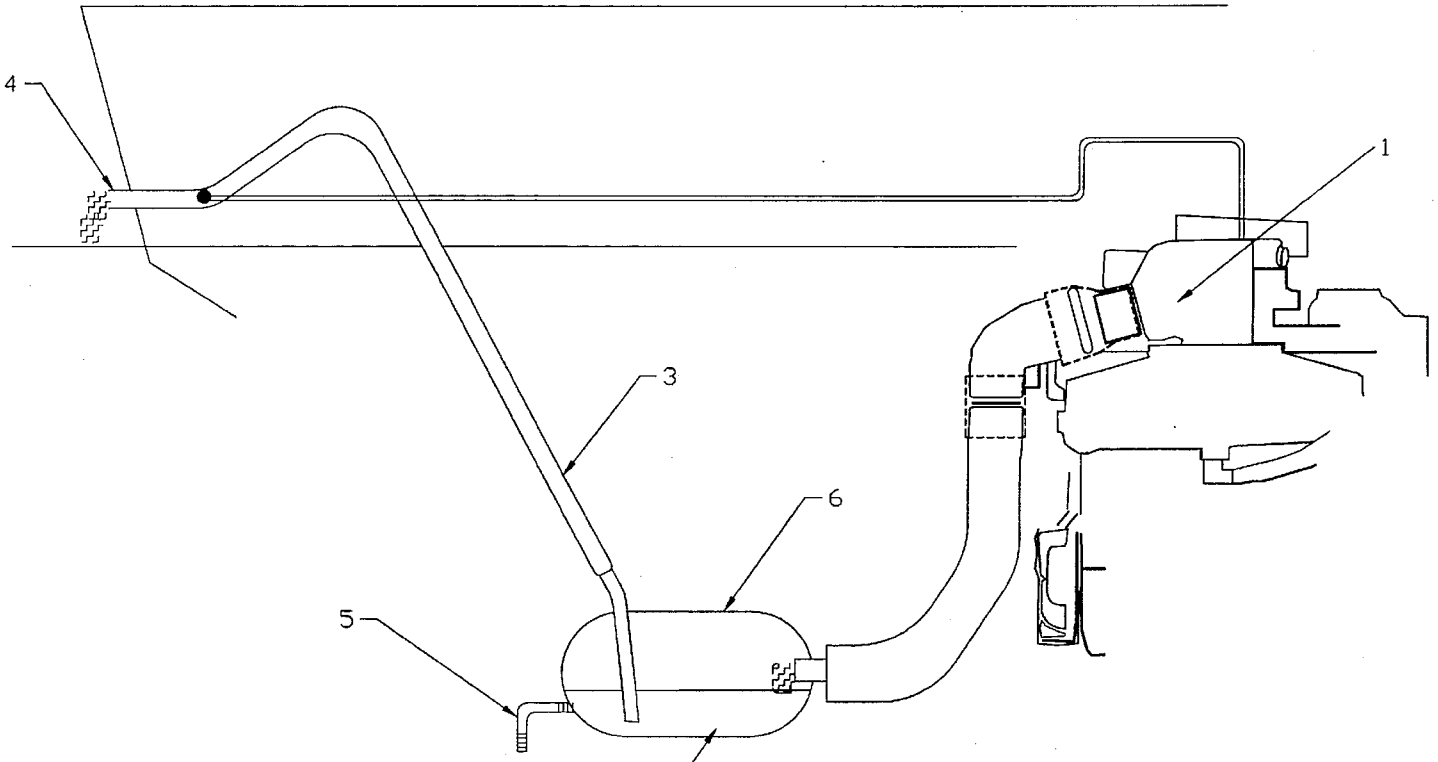
Figure 1 Prior Art
FIG. 1 is a partial cut away view of a conventional water lift muffler located within a water vessel.
Figure 2:
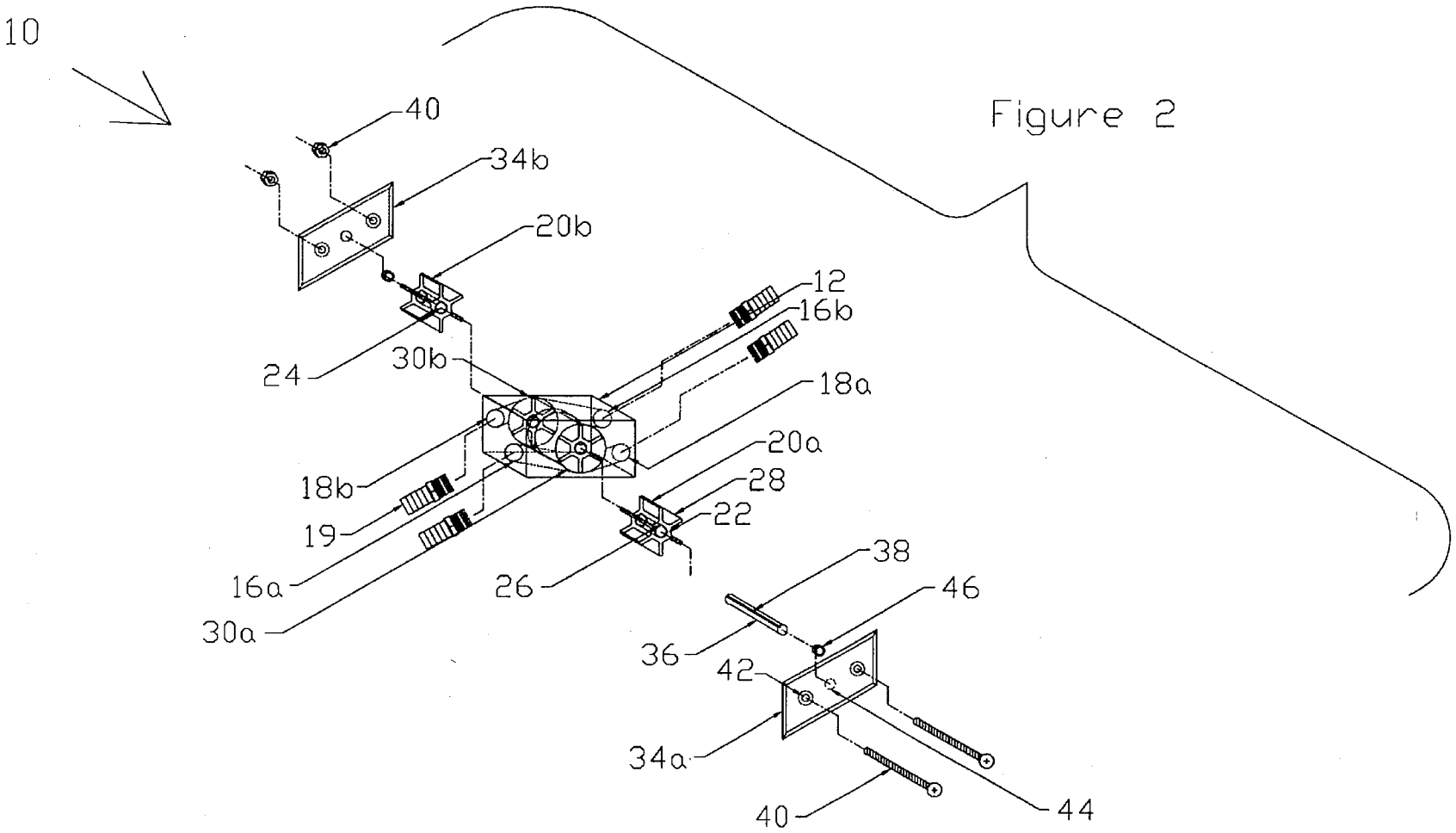
FIG. 2 is an exploded, perspective view of the preferred embodiment of the water-lift muffler evacuation device of the present invention, showing the parts of the device and their relation prior to assembly.

FIG. 2 illustrates the various components of the preferred embodiment of the water-lift muffler evacuation device 10 of the present invention. As seen, the water-lift muffler evacuation device 10 includes a housing 12 having a primary section 14*a* and a secondary section 14*b*. Each section includes an inlet port 16*a* and 16*b*, respectively, and an outlet port 18*a* and 18*b*. The primary section 14*a* of the housing 12 maintains a primary impeller or primary turbine 20*a* while the secondary section 14*b* of the housing 12 maintains a secondary impeller or secondary turbine 20*b*.

The primary section impellers and secondary section impellers, 20*a* and 20*b*, respectively of the water-lift muffler evacuation device each include a hub 22. Each hub 22 includes a shaft bore 24 located along the centerline of the hub 22. The shaft bore 24 of each impeller 20*a* and 20*b*, respectively, includes a keyway 26. A plurality of vanes 28, symmetrically arranged, extend radially from each hub 22 such that the plane of the face of each vane 28 stands parallel to the centerline of the shaft bore 24 and the vane tips end equidistant from the centerline of the shaft bore 24. The width of the vanes equals the width of the hubs.

Figure 3:
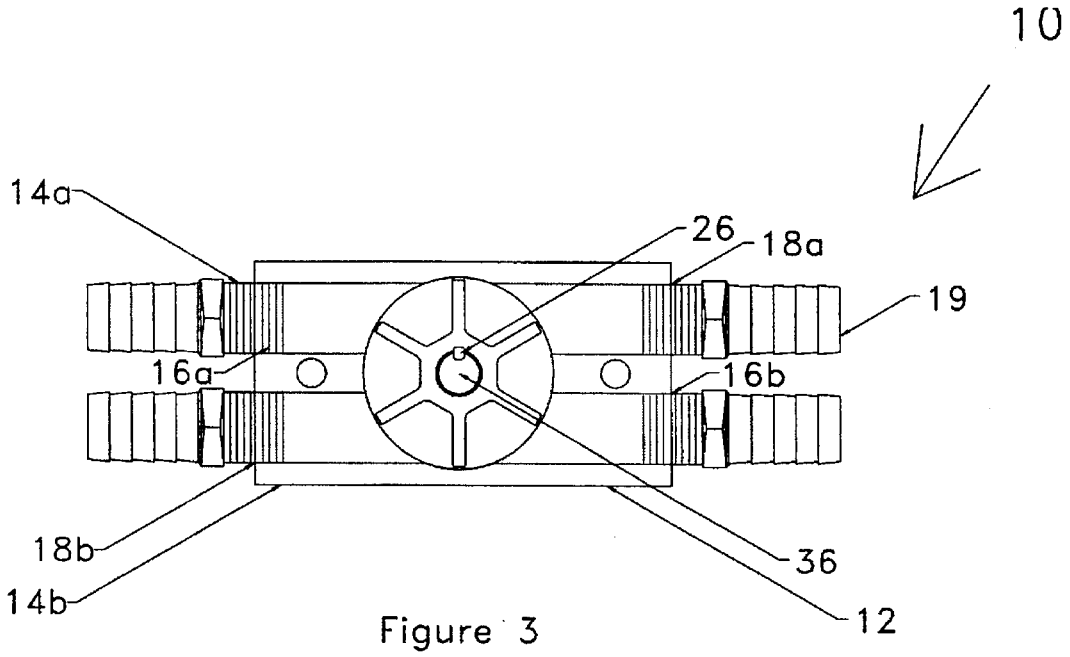
FIG. 3 is a side view of the water-lift muffler evacuation device of the present invention.
Figure 4:
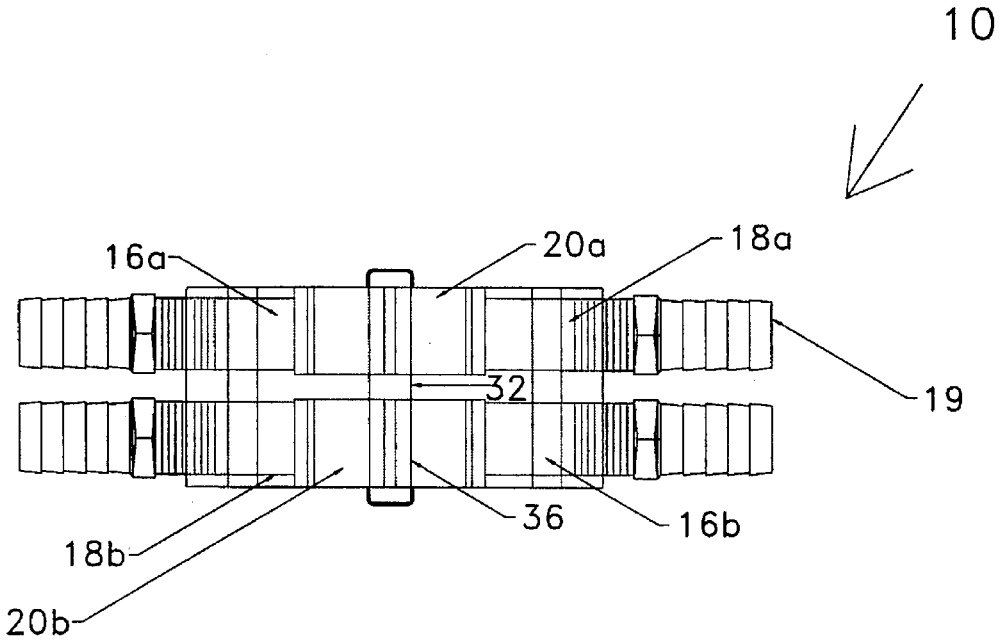
FIG. 4 is a top view of the water-lift muffler evacuation device of the present invention.

The primary section 14*a* of the housing, as seen in FIGS. 2–4, of the water-lift muffler evacuation device 10 includes a primary section impeller bore 30*a* that is adapted to receive the primary impeller 20*a*. The diameter of the primary section impeller bore 30*a* closely matches the outside diameter, defined by the vanes tips 28, of the primary section impeller 20*a*. The depth of the primary section impeller bore 30*a* closely matches the width of the primary section impeller 20*a*. The inlet port 16*a* and the outlet port 18*a* of the primary section 14*a* extends into the primary section impeller bore 30*a* for controlling fluid flow. Water is transported to and from the inlet port and outlet port via hosing (not illustrated). The hosing is connected to each port via a threaded coupling device or threaded hose fittings 19. When the primary section impeller 20*a* is installed into the primary section impeller bore 30*a*, the primary section impeller 20*a* will rotate, but the close match of respective depth and width and of respective diameters substantially frustrates water flow by the impeller sides or vane tips.

As also seen in FIGS. 2–4, the secondary section 14*b* of the housing 12 of the water-lift muffler evacuation device 10 includes a secondary section impeller bore 30*b*. The diameter of the secondary section impeller bore 30*b* closely matches the outside diameter, defined by the vanes tips 28, of the secondary section impeller 20*b*. The depth of the secondary section impeller bore 30*b* closely matches the width of the secondary section impeller 20*b*. The centerline of the secondary section impeller bore 30*b* coaxially aligns with the centerline of the primary section impeller bore 30*a*. The inlet port 16*b* and the outlet port 18*b* of the secondary section 14*b* extends into the secondary section impeller bore 30*b* for controlling fluid flow. Water is transported to and from the inlet port and outlet port via hosing (not illustrated). The hosing is connected to each port via a threaded coupling device 19. When the secondary section impeller installs into the secondary section impeller bore, the secondary section impeller 20*b* will rotate, but the close match of respective depth and width and of respective diameters substantially frustrates water flow by the impeller sides or vane tips.

As illustrated in FIG. 4, the housing 12 of the water-lift evacuation device 10 further includes a shaft bore 32. The shaft bore 32 connects the primary section 14*a* to the secondary section 14*b* of the housing 12. The shaft bore 32 coaxially aligns with the primary section impeller bore and the secondary section impeller bore 24.

As illustrated in FIG. 2, a shaft 36 is adapted to be received within the shaft bore 24 of the primary impeller 20*a*, the shaft bore 32 of the housing, and the shaft bore 24 of the secondary impeller 20*b*.

The diameter of the shaft bore 32 closely matches the shaft's 36 diameter. When the shaft 36 is install into the shaft bore, the shaft may rotate, but the close match of diameters substantially frustrates water flow by the housing and shaft.

This shaft 36 also includes a channel 38 that corresponds to the keyway 26 of the shaft bore of the primary impeller and the shaft bore of the secondary impeller. The use of a keyways 26 and channel 38 ensures the securement of the shaft to the primary impeller and the secondary impeller, while not interfering with the rotation of the shaft within the shaft bore 32 located between the primary section and the secondary section of the housing.

The housing 12 also includes covers 34*a* and 34*b*, respectively. These covers are adapted to secure and maintain the primary and secondary impellers 20*a* and 20*b*, within their respective section. At least one securing means 40 (illustrated as bolts and nuts in this figure) extend through openings 42 within the cover and openings (not illustrated) within the housing 12. The housing may also include any mounting means found convenient for permanent or temporary application, including simple extension of the cover bolts allowing for mounting by the cover bolts.

Each cover 34*a* and 34*b* includes a groove 44 that is adapted to receive and maintain a bushing 46. Once the bushing 46 is located in the groove 44, shaft 36 is attached thereto. This will provide for the ends of the shaft to be cushioned and to reduce friction between the shaft 36 and the covers 34.

When the water-lift muffler evacuation device 10 is assembled, the shaft 36 extends centrally into the primary impeller bore, the shaft bore of the housing, and the secondary impeller bore. The channel 38 of the shaft 36 receive the keyways 26 of the primary impeller 20*a* and the secondary impeller 20*b*. The impellers, once installed are located within their respective bores, while the key way and channel enforce simultaneous and equal rotation of the impellers and shaft. The bushing 46 are installed in the grooves 44 of the covers 34, preferably with slight interference on the outside diameters, but in accordance with proper particulars of bushing application art.

The covers 34*a* and 34*b* capture the impellers 20*a* and 20*b* and the shaft 36 where the shaft's ends rest in the bushings. The securing means 40 covers, protects, and secures the assembly 10.

Figure 5:
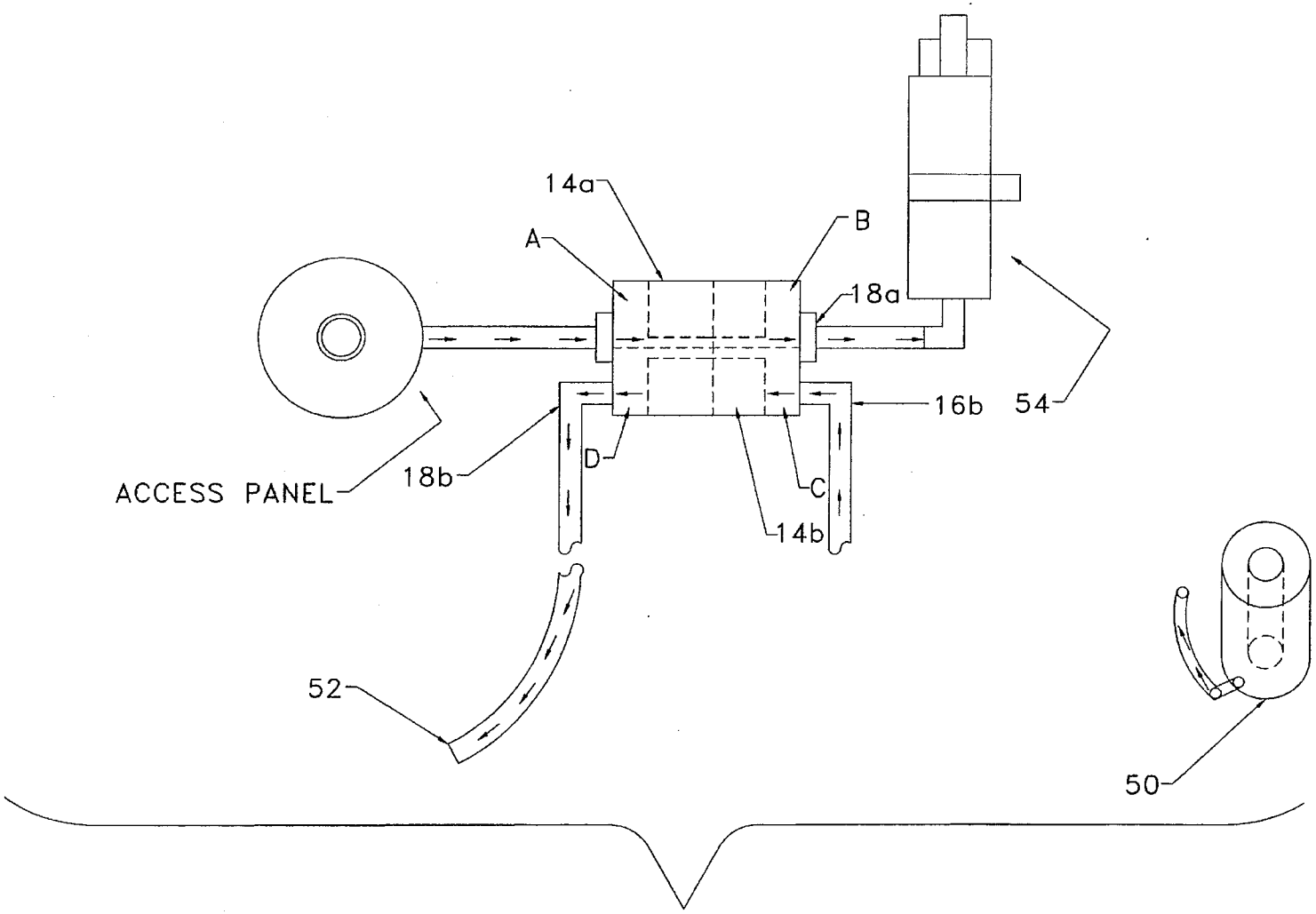
FIG. 5 is a conceptual flow diagram showing the interconnection of the evacuation device to a typical marine engine.

The primary section 14*a* of the housing 12 includes the primary inlet port 16*a* and the primary outlet port 18*a*, each having internal threads for receiving externally threaded hose fittings 19. The conceptual flow diagram showing the interconnection of the evacuation device to a typical marine engine is illustrated in further detail in FIG. 5. The primary inlet port 16*a* communicates to a first quadrant A of the primary section impeller bore. The primary outlet port 18*a* connects to a second quadrant B of the primary section impeller bore located adjacent to the first quadrant A. Fresh water, having sufficient flow and pressure, moving through the primary inlet port 16*a*, into the first quadrant A, into the second quadrant B and finally out the primary outlet port 18*a*, naturally drives the primary section impeller in rotation.

The secondary section 14b of the housing 12 includes the secondary inlet port 16b and a secondary outlet port 18b, each having internal threads for receiving externally threaded hose fittings 19. The secondary inlet port 16b communicates to a first quadrant C of the secondary section impeller bore. The secondary outlet port 18b connects to a second quadrant D of the secondary section impeller bore located adjacent to the first quadrant. The first quadrant C and the second quadrant D of the secondary section impeller bore relate to the first quadrant A and the second quadrant B of the primary section impeller bore; rotation of the primary section impeller 20a, and hence rotation of the secondary section impeller 20b, causes a vacuum in the first quadrant C of the secondary section impeller bore.

Where the secondary inlet port connects by hose to a muffler, silencer or suppressor 50 containing water acted on by pressure greater than the vacuum, for example, atmospheric pressure, in the first quadrant and secondary section inlet port, water flows naturally from the muffler 50 to the secondary inlet port 16b, through the first quadrant C and second quadrant D of the secondary impeller bore and, finally, to the secondary section outlet port 18b. Where the secondary section outlet port 18b connects by hose to an overboard drain 52, water flows overboard, thus evacuating the muffler as desired.

Particular applications of the water-lift evacuation device may require considering the relation of the evacuation device to the water level in the muffler, silencer or suppressor and height of the overboard drain for water flow to occur naturally and efficiently. Water flows naturally only with pressure differences between the surface of the water in the muffler and the secondary section inlet port greater than the head or lift the water must traverse.

It is noted that the water-lift muffler evacuation device 10 of the present invention can be utilized in combination with a conventional marine engine flushing device 54. The water-lift muffler evacuation device 10 would be located in series with the conventional marine engine flushing device 54.

The above described water-lift muffler evacuation device 10 can include other parts, not shown in any figure, should experience or particular application warrant. For example, performance in some application may demand a shaft seal separating the primary section and secondary section of the housing.

While the invention has been particularly shown and described with reference to the embodiments thereof, it will be understood by those skilled in the art that various changes in form and detail may be made without departing from the spirit and scope of the invention.

I claim:

1. A water lift muffler evacuation device to be coupled to a conventional water lift muffler, silencer or suppressor of a water vessel, for removing or evacuating water from the conventional water lift muffler, silencer or suppressor whether the water vessel is in or out of the water, said water lift muffler evacuation device comprising:

a housing coupled to a conventional water vessel having a primary section and a secondary section;

said primary section and said secondary section each include an inlet port and an outlet port;

said inlet port of said primary section is adapted to be coupled to a fresh water source;

said inlet port of said secondary section is coupled to a muffler, silencer or suppressor of said conventional water vessel;

said outlet port of said secondary section is coupled to an overboard drain means;

a first impeller means is located in said primary section and said first impeller means is coupled to a second impeller means located in said secondary section; and fresh water from said fresh water source activates said first impeller means and enables activation of said second impeller means for rendering a vacuum to exists between said second impeller means and said muffler, silencer, or suppressor, said vacuum will cause raw sea water to flow from said muffler, silencer or suppressor, through said second impeller means and to said overboard drain means for removing said raw sea water from said muffler, silencer or suppressor.

2. A water lift muffler evacuation device as in claim 1 wherein said outlet port of said primary section is coupled to a conventional marine engine flushing device.

3. A water lift muffler evacuation device as in claim 1 wherein said first impeller means is coupled to said second impeller means via a shaft.

4. A water lift muffler evacuation device as in claim 1 wherein said primary section includes a first bore for housing said first impeller means and said secondary section includes a second bore for housing said second impeller means.

5. A water lift muffler evacuation device as in claim 4 wherein a centerline of said first bore coaxially aligns with a centerline of said second bore.

6. A water lift muffler evacuation device as in claim 1 wherein a centerline of said primary section coaxially aligns with a centerline of said secondary section.

7. A water lift muffler evacuation device as in claim 1 wherein each impeller means includes a hub having plurality of vanes, symmetrically arranged and extending radially from each hub, said hubs are coupled via a coupling means.

8. A water lift muffler evacuation device as in claim 8 wherein said coupling means is a shaft, said first impeller means and said second impeller means resting in respective said first bore and said second bore; said shaft is rotatably constricted within said housing, and said first impeller means and said second impeller means are fixedly connected near distal ends of said shaft.

9. A water lift muffler evacuation device as in claim 7 wherein said shaft further includes a channel, each hub further includes a keyway, said channel receives each keyway for securement of said shaft to said first impeller means and said second impeller means.

10. A water lift muffler evacuation device as in claim 7 wherein said vanes include a first width and said hubs include a second width, and said first width is equal to said second width.

11. A water lift muffler evacuation device to be coupled to a conventional water lift muffler, silencer or suppressor of a water vessel, for removing or evacuating raw sea water from the conventional water lift muffler, silencer or suppressor whether the water vessel is in or out of the water, said water lift muffler evacuation device comprising:

a housing coupled to a conventional water vessel having a primary section and a secondary section;

said primary section and said secondary section are coaxially aligned and each include an inlet port and an outlet port;

said inlet port of said primary section is adapted to be coupled to a fresh water source;

said inlet port of said secondary section is coupled to a muffler, silencer or suppressor of said conventional water vessel;

said outlet port of said secondary section is coupled to an overboard drain means;

a first impeller means is located in said primary section and said first impeller means is coupled to a second impeller means located in said secondary section; and fresh water from said fresh water source activates said first impeller means and enables activation of said second impeller means for rendering a vacuum to exists between said second impeller means and said muffler, silencer, or suppressor, said vacuum will cause raw sea water to flow from said muffler, silencer or suppressor, through said second impeller means and to said overboard drain means for removing said raw sea water from said muffler, silencer or suppressor.

12. A Water lift muffler evacuation device as in claim 11 wherein said outlet port of said primary section is coupled to a conventional marine engine flushing device.

13. A water lift muffler evacuation device as in claim 11 wherein said first impeller means is copied to said second impeller means via a shaft.

14. A water lift muffler evacuation device as in claim 11 wherein said primary section includes a first bore for housing said first impeller means and said secondary section includes a second bore for housing said second impeller means.

15. A water lift muffler evacuation device as in claim 11 wherein each impeller means includes a hub having plurality of vanes, symmetrically arranged and extending radially from each hub, said hubs are coupled via a coupling means.

16. A water lift muffler evacuation device as in claim 15 wherein said coupling means is a shaft, said first impeller means and said second impeller means resting in respective said first bore and said second bore, said shaft is rotatably constricted within said housing, and said first impeller means and said second impeller means are fixedly connected near distal ends of said shaft.

17. A water lift muffler evacuation device as in claim 16 wherein said shaft further includes a channel, each hub further includes a keyway, said channel receives each keyway for securement of said shaft to said first impeller means and said second impeller means.

18. A water lift muffler evacuation device as in claim 15 wherein said vanes include a first width and said hubs include a second width, and said first width is equal to said second width.

* * * * *